US007599508B1

(12) United States Patent
Lynch et al.

(10) Patent No.: US 7,599,508 B1
(45) Date of Patent: Oct. 6, 2009

(54) LISTENING DEVICE CAP

(75) Inventors: Douglas P Lynch, Valencia, CA (US); Carla Mann Woods, Beverly Hills, CA (US)

(73) Assignee: Advanced Bionics, LLC, Valencia, CA (US)

( * ) Notice: Subject to any disclaimer, the term of this patent is extended or adjusted under 35 U.S.C. 154(b) by 573 days.

(21) Appl. No.: 10/823,880

(22) Filed: Apr. 14, 2004

Related U.S. Application Data

(60) Provisional application No. 60/469,082, filed on May 8, 2003.

(51) Int. Cl.
*H04R 25/00* (2006.01)

(52) U.S. Cl. ..... 381/330; 381/312; 381/326

(58) Field of Classification Search ..... 381/312, 381/314, 315, 322–324, 326–328, 331, 381, 381/330; 600/25; 607/55–57
See application file for complete search history.

(56) References Cited

U.S. PATENT DOCUMENTS

| | | | | |
|---|---|---|---|---|
| 5,824,022 | A * | 10/1998 | Zilberman et al. | 607/57 |
| 5,948,006 | A | 9/1999 | Mann | |
| 5,949,895 | A | 9/1999 | Ball et al. | |
| 6,275,736 | B1 | 8/2001 | Kuzma et al. | |
| 6,275,737 | B1 | 8/2001 | Mann | |
| 6,358,281 | B1 | 3/2002 | Berrang et al. | |
| 6,473,511 | B1 | 10/2002 | Aceti et al. | |
| 6,496,734 | B1 | 12/2002 | Money | |
| 6,560,488 | B1 | 5/2003 | Crawford | |
| 6,648,914 | B2 | 11/2003 | Berrang et al. | |
| 6,726,618 | B2 * | 4/2004 | Miller | 600/25 |
| 7,174,214 | B2 | 2/2007 | Seligman | |
| 7,266,208 | B2 | 9/2007 | Charvin et al. | |
| 7,349,741 | B2 | 3/2008 | Maltan et al. | |
| 2007/0106345 | A1 | 5/2007 | Seligman | |
| 2007/0191673 | A1 | 8/2007 | Ball et al. | |

FOREIGN PATENT DOCUMENTS

WO 2005/110530 A2 11/2005

OTHER PUBLICATIONS

"Adjustable Strength Magnet System for a Cochlear Implant Headpiece", IP.com Publication, IPCOM000010043D, (Oct. 2002).

JABRA Corporation, "JABRA FreeSpeak(tm) BT200 Wireless Mobile Headset Users Manual," JABRA Corporation of 9171 Towne Centre Drive, Suite 500, San Diego, California 92122, (2004).

(Continued)

*Primary Examiner*—Huyen D Le
(74) *Attorney, Agent, or Firm*—Mary Elizabeth Bush; Philip H. Lee; Victoria A. Poissant

(57) ABSTRACT

An assistive listening device cap attaches to a headpiece of a cochlear implant behind-the-ear (BTE) unit, an other BTE unit, an earhook, or an external component unit to supplement or replace components thereof. The cap may receive signals from sources outside the BTE unit(s), earhook, and/or external component unit. The cap communicates with the BTE unit(s), earhook, and/or external component unit using direct, wired, or wireless technology.

20 Claims, 4 Drawing Sheets

OTHER PUBLICATIONS

Qian, et al., "A Bluetooth-Based Wireless Phone Adapter For Cochlear Implant Users", Department of Electrical Engineering University of Texas at Dallas, www.utdallas.edu/~loizou/cimplants, Asilomar (2001).

Qian, et al., "A Phone-Assistive Device Based on Bluetooth Technology for Cochlear Implant Users", IEEE Transactios on Neural Systems and Rehabilitation Engineering, (Jan. 2003), pp. 282-287.

Cap. (2009). In Merriam-Webster Online Dictionary. Retrieved Jan. 21, 2009, from http://www.merriam-webster.com/dictionary/cap.

Cap. (n.d.). Webster's New Millennium™ Dictionary of English , Preview Edition (v 0.9.7). Retrieved Jan. 21, 2009, from Dictionary.com website: http://dictionary.reference.com/browse/cap.

Cap. Retrieved Jan. 21, 2009, from http://www.yourdictionary.com/cap.

House, "The AllHear Cochlear Implant System: the AllHear Device, their Manufacture, Preliminary Test Results, & the Future." Retrieved Jan. 29, 2009 from http://www.allhear.com/media.php.

BionicEar.com—Harmony Cochlear Implant by Advanced Bionics.

Welcome to Spokane Ear, Nose&Throat Clinic, P.S. Surgery Center. Retrieved Jan. 20, 2009 from http://www.spokaneent.com/cochlear_implants.html.

Cochlear Implant. Medical Articles of Interest from Garamchai.Com. Retrieved Jan. 20, 2009 from http://www.garamchai.com/DesiTrendsMedical1.htm.

Cochlear Implant Programme, Cochlear Implants, Speech Laboratory, Audiology, E . . . Retrieved Jan. 20, 2009 from http://www.kkrenthospital.org/surgery_cochlear.htm.

Cochlear implants bring identity change, Otolaryngology—Head and Neck Surgery, Breakthrough, Autumn 2004, p. 6.

UCSF—Cochlear Implant. Retrieved Jan. 20, 2009 from http://cochlearimplant.ucsf.edu/page.asp?bodyid=implantsystem.

Cochlear Implants and Children, Advance for Audiologists Sep./Oct. 2000, p. 26. www.advanceforAUD.com.

What Are Cochlear Implants and How Does it Work?—Cochlear Implants—My Baby's Hearing. Retrieved Jan. 20, 2009 from http://www.babyhearing.org/HearingAmplification/Cochlear/whathow.asp.

* cited by examiner

LISTENING DEVICE CAP

The present application claims the benefit of U.S. Provisional Application Ser. No. 60/469,082, filed May 8, 2003, which application is herein incorporated by reference in its entirety.

FIELD OF THE INVENTION

The present invention relates to hearing aid and cochlear implant systems and more particularly, to auxiliary devices and components for hearing aid and cochlear implant systems.

BACKGROUND OF THE INVENTION

Most people do not like heavy objects hanging from their ears. On occasion some people dangle heavy earrings from their ears. But, in general, most people do not like to carry heavy objects, day after day, from their ears. It is uncomfortable. It is unpleasant. And sometimes, it is unattractive.

Individuals who use technology to assist their hearing are often required to place at least part of that technology behind their ears inside behind-the-ear (BTE) cochlear implant or hearing aid systems and units, earhooks, or other external component units. The term "external" means not fully implanted within the body of a patient. These BTE units must remain small, light weight, and attractive in order to please the individuals wearing them. The shell of a BTE unit provides slightly more room for electronics than a thimble has room to be filled with water. Yet, a tremendous amount of complex technology needs to be packed into the limited physical space of a BTE unit shell. Limited space limits technology. And when technology is limited, individuals are not able to hear as much or as well as they would like to be able to hear.

Others have tried to solve this dilemma by building sizable add-on modules to the BTE unit. This improves the technology of the BTE unit, but adds to the weight problem and may cause discomfort to the user's ear. Further, add-ons require users to remove their BTE unit to put a unique connector on the BTE unit, then to plug this connector into the assistive technology. The assistive technology, then is placed on the head or body of the user, often detracting from the aesthetic appearance of the user.

A solution is needed for BTE units that neither compromises space nor technology, weight nor function. The more technology a BTE unit holds, the more uncomfortable, unpleasant, and unattractive BTE users may feel. Yet, the less technology a BTE unit holds, the less a BTE user will be able to hear. An assistive hearing unit is needed that adds the functionality of technology to a BTE unit without making the BTE unit heavier or larger. Further, this assistive hearing unit should not require the user to remove a BTE unit, nor should it detract from the user's appearance. The crisp, clear sounds that come from using assistive hearing devices should not be upstaged by undesirable side effects of those devices.

SUMMARY OF THE INVENTION

The present invention solves the above and other needs and eliminates, or at least minimizes, the undesirable side effects that accompany heavy and large Behind-the-Ear (BTE) or other units. At the same time, the present invention provides a means to increase the amount of technology used with a BTE unit. Further, the present invention does not require the user to take the BTE unit from behind the ear. In short, the present invention permits an individual to wear a lightweight, small, aesthetic BTE unit that incorporates an increased amount of assistive hearing technologies without having to remove that unit.

The present invention satisfies the above and other needs by providing an assistive listening device cap (ALD Cap) that is placed on top of a cochlear implant headpiece. Cochlear implant headpieces attach to the head, not the ear. The ALD Cap adheres to the headpiece through magnetic attraction or other means of fixation. The ALD Cap includes components that supplement or replace the components in the BTE unit. The ALD Cap communicates with the BTE unit, preferably through a BTE earhook that is attached to the BTE unit, either through wired or wireless communications.

Alternately, the ALD Cap of the present invention may attach to head-mounted technology, such as head-mounted transmitters or microphones used in conjunction with implantable hearing aids, cochlear implant processors, or other implantable hearing devices that do not use BTE units. For hearing aids and cochlear implant processors that are head-mounted and do not use BTE components, the ALD Cap provides access to assistive listening technology without the need for introducing components worn on or in the ear.

BRIEF DESCRIPTION OF THE DRAWINGS

The above and other aspects of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

The present invention adds functionality to cochlear implant and/or implantable hearing aid devices and systems without adding substantial weight or size to these associated devices or systems to their associated, head-mounted, external components. The present invention accomplishes this by providing an Assistive Listening Device (ALD) Cap that is placed on top of a headpiece that is associated with a Behind-the-Ear (BTE) unit. Alternately, the ALD Cap is place on top of the head-mounted external components associated with a cochlear implant or hearing aid system that does not use a BTE unit. The ALD Cap communicates with the BTE unit or other external components directly or through an auxiliary attachment, e.g., an earhook, attached to the BTE unit. The ALD Cap contains electronics that supplement or replace the functionality of the BTE unit or head-mounted external components.

Figure 1:
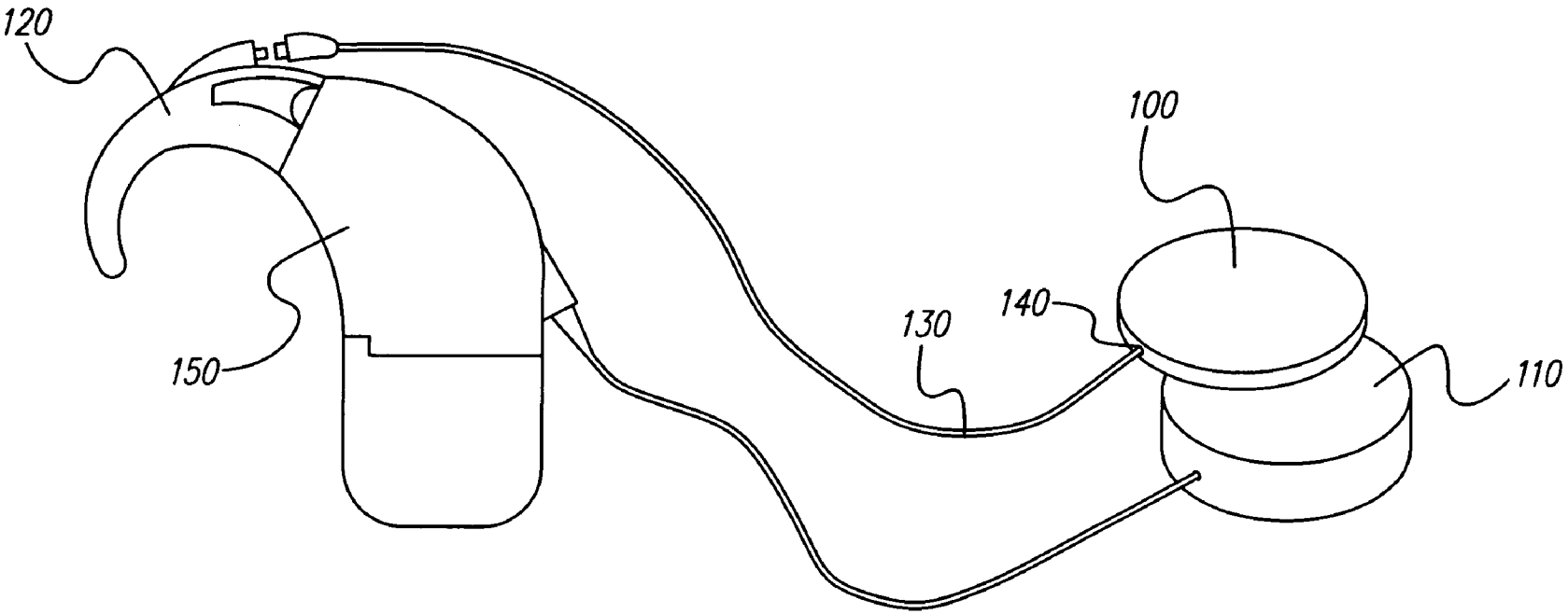
FIG. 1 is a perspective view of a wired Assistive Listening Device (ALD) Cap, a headpiece, a Behind-the-Ear (BTE) earhook, and a BTE unit.

As shown in FIG. 1, an embodiment of the present invention is an ALD Cap 100 with electronic and other components. ALD Cap 100 may be attached to the outer surface of a headpiece 110 through a magnetic or other fixation means. Equivalent fixation means include velcro, adhesive, glue, pocketed, threaded, snap-on, and any other means of attaching two items together that is compatible with the structure and function of the present invention. In the embodiment of FIG. 1, ALD Cap 100 communicates with a direct connect audio input earhook 120 through a cable 130 that attaches ALD Cap 100 and earhook 120 together. Cable 130 exits ALD Cap 100 at a cable connector 140. Earhook 120 is attached to a BTE unit 150 of a cochlear implant. Similar BTE units, including BTE units for implantable hearing aid systems, may be used with the present invention. ALD Cap 100 contains electronics that add or replace the functionality of the electronics of BTE unit 150 without adding substantially to the weight dr size of BTE unit 150. ALD Cap 100 is not a part of BTE unit 150. The only component of this invention that adds any weight or structure to BTE unit 150 is cable 130. Cable 130 attaches to earhook 120, which earhook 120 is attached to BTE unit 150. Because ALD Cap 100 does not add any substantial weight or size to BTE unit 150 or earhook 120, a user's ear is not unduly burdened with components and electronics of increasing weight and size. The end result of the present invention may provide a user with a significant increase in functionality and operation of the user's hearing system without adding any weight or size to the BTE portion of the hearing system.

Figure 2:
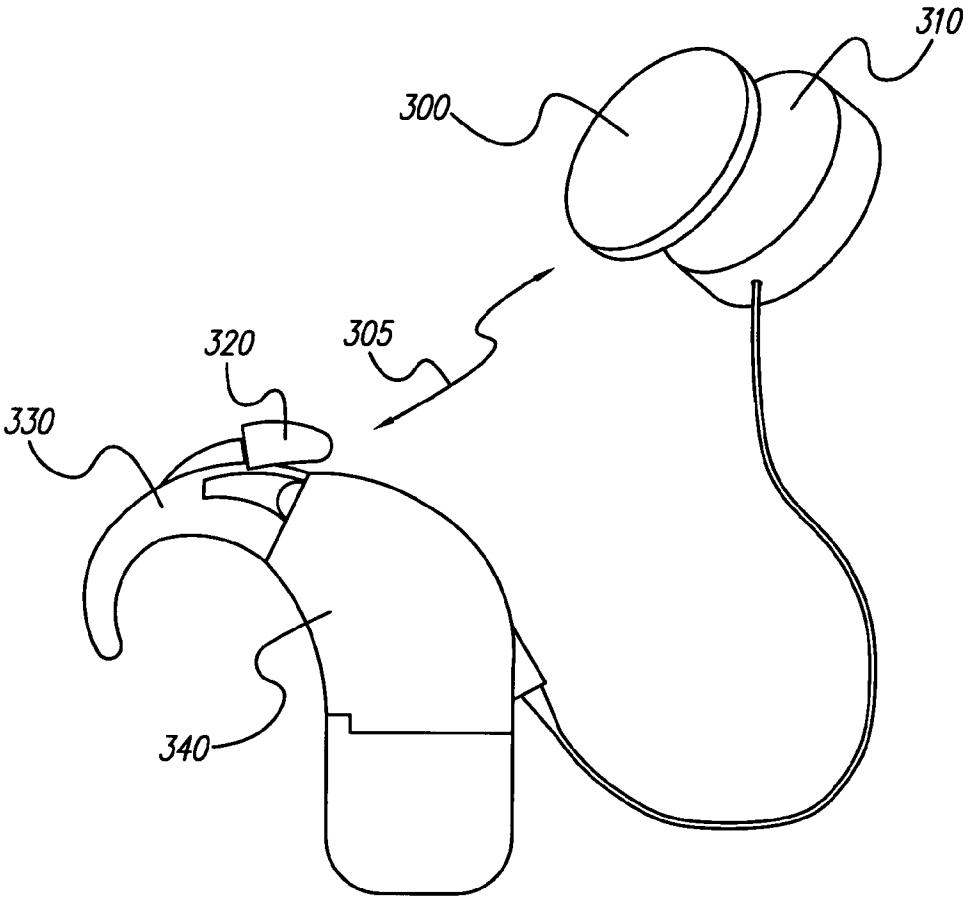
FIG. 2 is a perspective view of a wireless ALD Cap, a headpiece, a BTE earhook, and a BTE unit.

As shown in FIG. 2, another embodiment of the present invention is an ALD Cap 300 with electronic and other components that is attached to the outer surface of a headpiece 310 through a magnetic or other fixation means such as those mentioned above. In the embodiment of FIG. 2, ALD Cap 300 communicates 305 with a radio frequency (RF) receiver 320 of a direct connect audio input earhook 330 through wireless RF signals. All known means of wireless communication 305 are contemplated by the present invention including, but not limited to, RF, infra-red, magnetic, Bluetooth, and optical communications. Bluetooth is a radio technology capable of linking two or more devices in communication with each other over a relatively short distance of approximately 30 feet, or 10 meters.

Earhook 330 is attached to a BTE unit 340. BTE unit 340, as well as any other BTE unit of the present invention, may be a Behind-the-Ear unit of cochlear implant systems, implantable hearing aid systems, and any other hearing systems.

Figure 3:
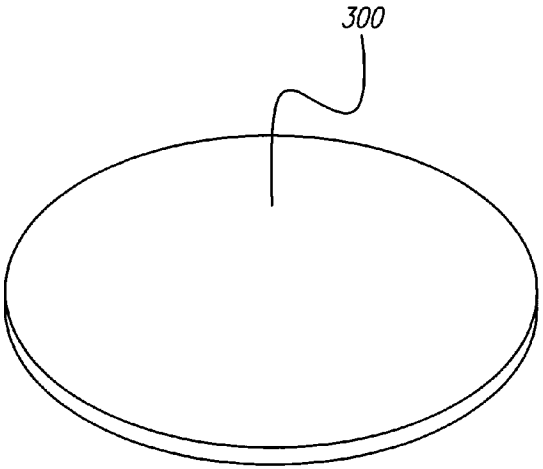
FIG. 3 is a diagonal side view of a wireless ALD Cap.

FIG. 3 shows a diagonal side view of ALD Cap 300. ALD Cap 300 may be any size, shape, or dimension compatible with at least one of the general principles of the present invention, including: providing a mechanical attachment to a unit such as a head piece, complementing the aesthetics of its associated system, enhancing the communicating capacity of its associated system, and increasing the overall functionality of its associated system. The ALD Cap 300 may thus be modified to fit and function with a variety of hearing systems and components in a variety of different embodiments.

Figure 4:
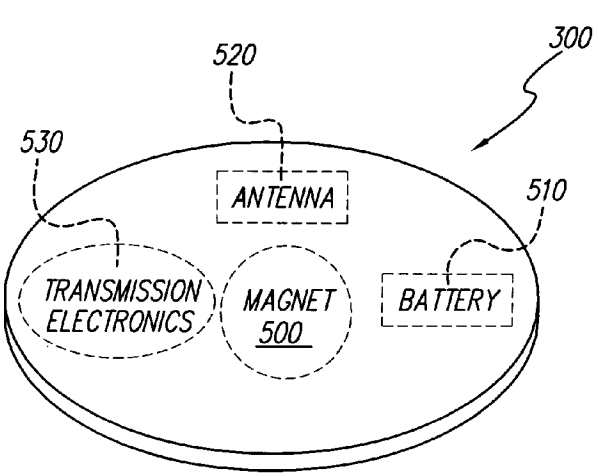
FIG. 4 is a diagonal top view of the inside circuitry of a wireless ALD Cap.

As shown in FIG. 4, ALD Cap 300 may include a magnet 500 to help ALD Cap 300 adhere to headpiece 310; a battery 510 for running the circuitry and other electronic components of ALD Cap 300; receiver electronics 520 for receiving data signals such as RF signals from a source outside ALD Cap 300; and transmission electronics 530 for sending data signals, such as RF signals, to RF receiver 320 of earhook 330. In an alternate embodiment, receiver electronics 520 and transmitting electronics 530 may be combined in the same structure and location within the ALD Cap 300. Battery 510 may be a primary battery that is replaceable or non-replaceable, may be a directly or inductively rechargeable battery, or may be any combination thereof. In an alternative embodiment, battery 510 is replaced with a power coil or other structure known in the art capable of receiving power directly or inductively from another source outside ALD Cap 300.

Further alternate embodiments of receiver electronics 520 and transmission electronics 530 permit both to communicate using optical, infra-red, magnetic or other data transmission signals. Other embodiments of the present invention permit transmission electronics 530 to send data signals to a receiver inside the body of earhook 330, outside the body of earhook 330, inside the body of BTE unit 340, or outside the body of BTE unit 340. Battery 510 is removable from underneath ALD Cap 300. A magnet with increased magnetic strength may need to be placed inside headpiece 310 to permit ALD Cap 300 to adequately adhere to headpiece 310.

ALD Cap 300 is neither attached to BTE unit 340 nor earhook 330. Rather, ALD Cap 300 communicates with BTE unit 340 and/or earhook 330 through wireless communications. As a result, ALD Cap 300 is capable of adding to or replacing the functionality of BTE unit 340 and/or earhook 330 and/or other hearing system components without adding to the weight or size of BTE unit 340 and/or earhook 330. In this manner, a user's ear is not unduly burdened, and the user is able to use a maximally functional BTE unit without suffering the undesirable side effects of discomfort or displeasure. Further, because the ALD Cap of the present invention easily attaches to a headpiece without adding substantial structure, the user is able to employ the present invention in an aesthetically-pleasing manner without ever having to remove the BTE unit to use the ALD Cap.

Figure 5:
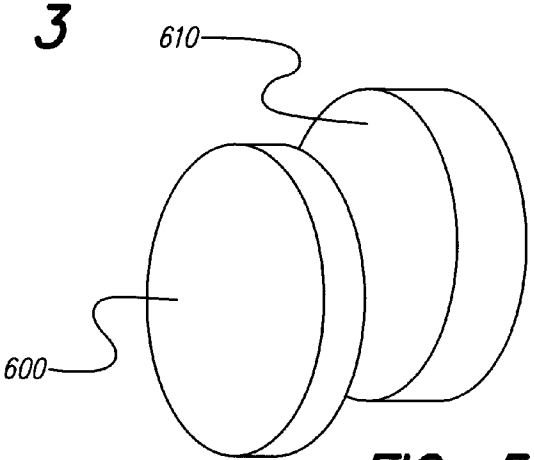
FIG. 5 is a diagonal top view of an ALD Cap connecting to a head-mounted cochlear implant or implantable hearing aid processor.

As shown in FIG. 5, another embodiment of the present invention is an ALD Cap 600 connected to a head-mounted external component unit 610. In this particular embodiment, external component unit 610 is used with a hearing system that does not employ a BTE unit. External component unit 610 includes external components that communicate with a cochlear implant or implantable hearing aid unit according to the wired and wireless methods described in this specification or otherwise known in the art. By attaching to the exterior of head-mounted unit 610 and communicating with unit 610, ALD Cap 600 provides access to assistive listening technology without the need for introducing components worn on or in the ear. This alleviates a user from needlessly toting relatively heavy hearing components that otherwise would traditionally be worn behind the ear inside a BTE unit.

An ALD Cap of the present invention can include other components, such as indicator electronics and related display components that sense and indicate the functional status of electronics in the ALD Cap, a headpiece, an earhook, an external component unit, or a BTE unit. A "firefly" light, or LED indicator, is an example of an indicator; the firefly lights a bulb located on the ALD Cap whenever the firefly electronics sense that a cochlear speech processor or other functional unit is turned on and functioning properly.

Users of BTE units can wear the present invention by attaching an ALD Cap to the exterior of a headpiece and wearing either an earhook and/or BTE unit with a cable connection, an earhook and/or BTE unit with an RF or other communications receiver, or any other earhook and/or BTE unit. Users of head-mounted external component units can wear the present invention by attaching an ALD Cap to the exterior of an external component unit. To use the present invention, users simply turn the power on the ALD Cap and place it on top of their existing headpiece or other external component unit. The ALD Cap then receives RF or other signals and transmits them either to an earhook, a BTE unit, external head-mounted components, or other hearing system components via wire (including direct contact) or wireless signals.

Having an RF or other communications-based receiver in the earhook, body of the BTE unit, external component unit, or implanted components allows for a range of assistive listening technologies to be developed and integrated into ALD Caps. These caps can be interchangeable to meet different assisted listening device needs of users. The caps may reduce the weight and size of any BTE unit on a user's ear while providing maximum functionality to the user's listening device. In other applications or embodiments, the ALD Caps completely eliminate the need for a BTE unit by carrying components that otherwise would have been carried by a BTE unit. The simple connection of an ALD Cap to a headpiece or other external component unit and of a connection cable to an earhook and/or BTE unit does not require the user to remove the BTE device or external component unit in order to place the ALD Cap. Finally, the minimal addition of the ALD Cap to the headpiece or other external component unit remains aesthetically agreeable for users.

Figure 6:
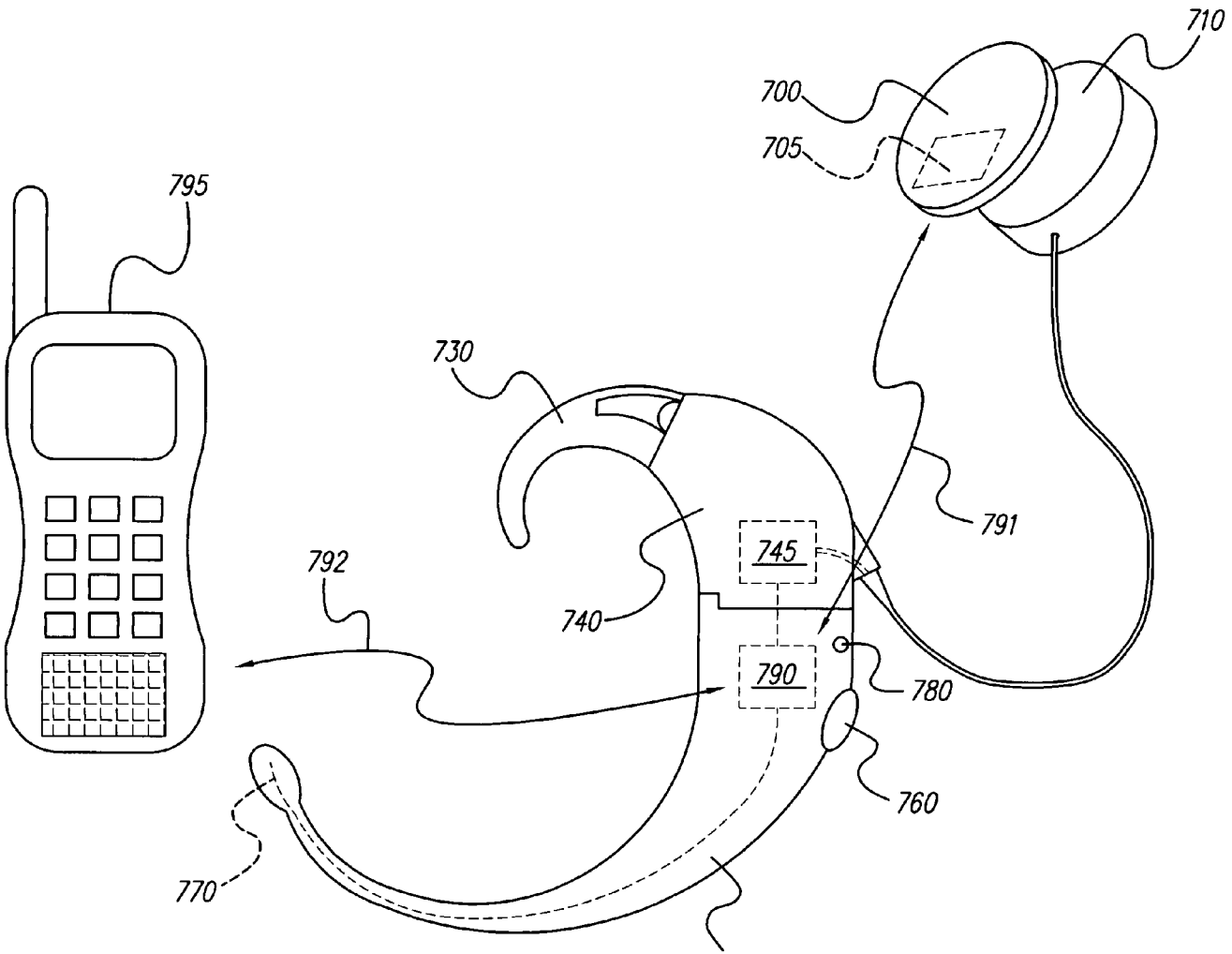
FIG. 6 is a side view of a wireless ALD Cap, a headpiece, a BTE earhook, and a BTE unit with a phone adapter employing Bluetooth technology.

An embodiment of the present invention is shown in FIG. 6. FIG. 6 is a side view of an ALD Cap 700 configured to mechanically join with a headpiece 710. The headpiece 710 is in electrical communication with a BTE unit 740. BTE unit 740 may include a speech processor 745, an earhook 730, and a cell phone or telephone adapter 750. The phone adapter 750 may include Bluetooth wireless communications technology 790 that transmits and receives wireless signals 792 to and from a cell phone or telephone 795. A system and method of Bluetooth assistive listening technology for cochlear implant speech processors is explained in "A Phone-Assistive Device Based on Bluetooth Technology for Cochlear Implant Users", Qian, et al., IEEE Transactions on Neural Systems and Rehabilitation Engineering, pp. 282-7, incorporated herein by reference in its entirety.

The Bluetooth technology 790 of the phone adapter 750 may also communicate wireless signals 791 with corresponding Bluetooth technology 705 in the ALD Cap 700. The phone adapter 750 may include a multi-function, or "answer/end", button 760 that controls various functions of adapter 750 including initiating, answering, transferring, and ending telephone calls. The button 760 may also be used to turn the adapter 750 on and off and pair the adapter 750 to a particular phone 795 employing Bluetooth communications. A related Bluetooth headset not employing cochlear implant technology is described in the JABRA FreeSpeak™ BT200 Wireless Mobile Headset Users Manual, incorporated herein by reference in its entirety, and available from JABRA Corporation of 9171 Towne Centre Drive, Suite 500, San Diego, Calif. 92122.

The phone adapter 750 may also include a microphone 770 capable of receiving audio input from a user's voice which is transmitted through the Bluetooth technology 790 of the adapter 750 to the phone 795 and ultimately to an individual on the receiving end of the phone conversation. The phone adapter 750 may also include an LED indicator light 780 that shows the relative status of the adapter 750, i.e., whether it is in active communications with a call in progress, in standby mode waiting for a phone call, or turned off. The phone adapter 750 may include a primary cell or rechargeable battery or may run off of inductive power from an outside source or direct power from a battery located within the speech processor portion of the BTE unit 740.

While the invention herein disclosed has been described by means of specific embodiments and applications thereof, numerous modifications and variations could be made thereto by those skilled in the art without departing from the scope of the invention set forth in the claims.

What is claimed is:

1. A system for an individual with impaired hearing, comprising:

a behind-the-ear (BTE) unit;

a head-mounted external component configured to communicate with the BTE unit and with an implanted device; and an assistive listening device cap configured to attach to the head-mounted external component and to be worn external to a patient's body;

wherein the assistive listening device cap includes data communication electronics;

wherein the assistive listening device cap is configured to mechanically attach to the exterior surface of the head-mounted external component; and wherein the data communication electronics are configured to communicate with corresponding communication electronics within the head-mounted external component.

2. The system of claim 1, the behind-the-ear unit including a cochlear implant speech processor.

3. The system of claim 1, wherein the data communication electronics are configured to communicate with corresponding communication electronics of at least one of the behind-the-ear unit, the head-mounted external component, an earhook attached to the behind-the-ear unit, and a Bluetooth enabled phone adapter.

4. The system of claim 1, wherein the data communication electronics are configured to communicate with corresponding communications electronics implanted within the head of a patient with impaired hearing.

5. The system of claim 1, wherein the data communication electronics are configured to communicate with the communication electronics of the head-mounted external component through at least one of direct electrical contacts, wireless signals, and electrically conductive wire.

6. The system of claim 5, wherein the wireless signal is selected from the group comprising an infra-red signal, radio-frequency signal, optical data signal, and Bluetooth wireless signal.

7. The system of claim 1, wherein the data communication electronics are powered by at least one of a primary battery located within the assistive listening device cap, a rechargeable battery located within the assistive listening device cap, and an external power source capable of transmitting energy to the electronics of the assistive listening device cap.

8. The system of claim 1, wherein the assistive listening device cap is configured to mechanically attach to the head-mounted external component by means of magnetic force.

9. The system of claim 1, wherein the data communication electronics are configured to communicate with the communication electronics of the head-mounted external component through direct electrical contacts.

10. The system of claim 1, wherein the data communication electronics are configured to communicate with the communication electronics of the head-mounted external component through wireless signals.

11. The system of claim 1, wherein the data communication electronics are configured to communicate with the communication electronics of the head-mounted external component through electrically conductive wire.

12. The system of claim 1, wherein the data communication electronics are powered by a primary battery located within the assistive listening device cap.

13. The system of claim 1, wherein the data communication electronics are powered by a rechargeable battery located within the assistive listening device cap.

14. The system of claim 1, wherein the data communication electronics are powered by an external power source capable of transmitting energy to the electronics of the assistive listening device cap.

15. A method for a patient to use an implanted hearing device, comprising:

wearing a behind-the-ear (BTE) unit;

attaching to the head a head-mounted external component configured to communicate with the BTE unit and with an implanted device; and mechanically attaching an assistive listening device cap to the head-mounted external component and external to the patient's body, wherein the assistive listening device cap includes data communication electronics configured to communicate with corresponding communication electronics within the head-mounted external component.

16. A system for an individual with impaired hearing, comprising:

an implantable hearing device;

a behind-the-ear unit;

a head-mounted external component configured to communicate with the behind-the-ear unit and the implantable hearing device; and an assistive listening device cap configured to attach to the head-mounted external component and to be worn external to a patient's body, wherein the assistive listening device cap includes data communication electronics configured to communicate with corresponding communication electronics within the head-mounted external component.

17. The system of claim 16, wherein the implantable hearing device comprises a cochlear implant.

18. The system of claim 16, wherein the implantable hearing device comprises an implantable hearing aid.

19. The system of claim 16, wherein the data communication electronics are configured to communicate with the communication electronics of the head-mounted external component through at least one of direct electrical contacts, wireless signals, and electrically conductive wire.

20. The system of claim 16, wherein the data communication electronics are powered by at least one of a primary battery located within the assistive listening device cap, a rechargeable battery located within the assistive listening device cap, and an external power source capable of transmitting energy to the electronics of the assistive listening device cap.

* * * * *